United States Patent [19]

Ashworth

[11] 4,097,361

[45] Jun. 27, 1978

[54] PRODUCTION OF LIQUID AND GASEOUS FUEL PRODUCTS FROM COAL OR THE LIKE

[75] Inventor: Robert A. Ashworth, Strongsville, Ohio

[73] Assignee: Arthur G. McKee & Company, Independence, Ohio

[21] Appl. No.: 717,102

[22] Filed: Aug. 24, 1976

[51] Int. Cl.[2] ..... C10G 1/08; C10J 3/62

[52] U.S. Cl. ..... 208/10; 208/8; 208/127; 48/210; 48/197 R

[58] Field of Search ..... 208/8, 10, 127; 48/210, 48/197 R

[56] References Cited

U.S. PATENT DOCUMENTS

| | | | |
|---|---|---|---|
| 3,617,513 | 11/1971 | Wilson et al. | 208/8 |
| 3,661,543 | 5/1972 | Saxton | 208/127 |
| 3,671,418 | 6/1972 | Gatsis | 208/10 |
| 3,726,784 | 4/1973 | Correa et al. | 208/8 |
| 3,816,084 | 6/1974 | Moser et al. | 208/127 |
| 4,060,478 | 11/1977 | Lang | 48/197 R |

*Primary Examiner*—Delbert E. Gantz
*Assistant Examiner*—Joan Thierstein
*Attorney, Agent, or Firm*—Bosworth, Sessions & McCoy

[57] ABSTRACT

A continuous deep hydrogenation coal liquefaction process is disclosed wherein a slurry of powdered coal or other carbonaceous material in a recycle solvent is passed with hydrogen through a hydroextraction unit, the heavy coal extract remaining after removal of gas and oil is then fed into a low-temperature fluidized-bed pyrolysis unit, and the char and ash is fed from the pyrolysis unit to a high-temperature fluidized-bed char gasification unit. The gasification unit is specially constructed to provide continuous ash agglomeration and has a funnel-shaped grid plate at the bottom of the fluidized bed and an elutriation leg of reduced diameter at the bottom of the grid plate. Air or oxygen is introduced near the top of the elutriation leg to provide a high temperature such that the ash particles are continuously softened and caused to accrete or agglomerate in a hot spouting zone at the base of the grid plate. Steam is directed upwardly through the elutriation leg so that the smaller lighter agglomerated ash particles are supported in the bed and the larger heavier agglomerated ash particles fall to the bottom for removal. A portion of the hot agglomerated ash from the upper portion of the bed is continually recycled through the pyrolysis unit to function both as a catalyst and as the sole heat source. A portion of the ash may also be recycled with the slurry fed to the hydroextraction unit to serve as a hydrogenation catalyst.

26 Claims, 2 Drawing Figures

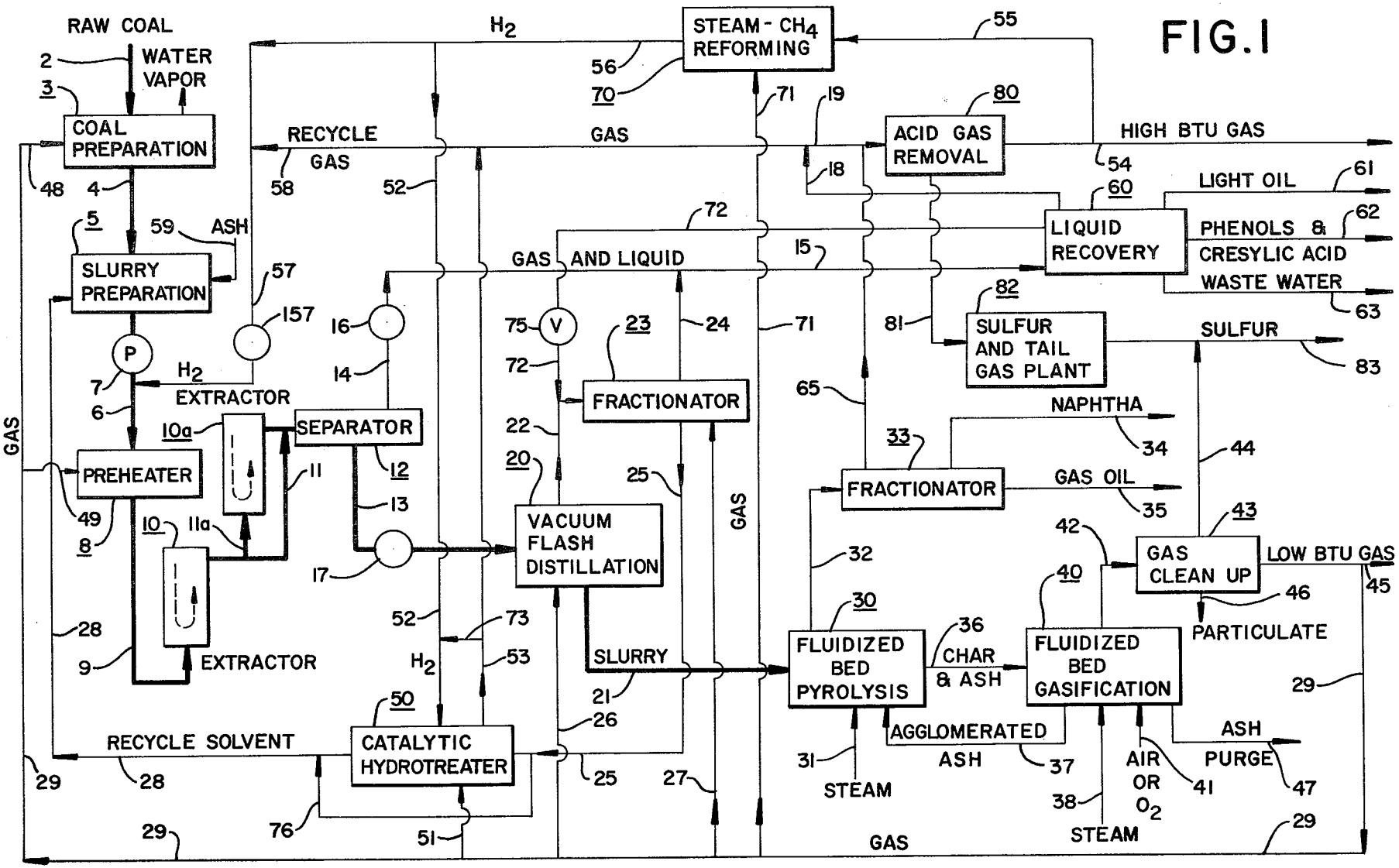
FIG. 1
RAW COAL
WATER VAPOR
COAL PREPARATION
SLURRY PREPARATION
ASH
PREHEATER
EXTRACTOR
SEPARATOR
RECYCLE GAS
STEAM - CH4 REFORMING
ACID GAS REMOVAL
HIGH BTU GAS
LIQUID RECOVERY
LIGHT OIL
PHENOLS & CRESYLIC ACID
WASTE WATER
SULFUR AND TAIL GAS PLANT
SULFUR
NAPHTHA
GAS OIL
FRACTIONATOR
GAS AND LIQUID
VACUUM FLASH DISTILLATION
SLURRY
GAS CLEAN UP
LOW BTU GAS
PARTICULATE
FLUIDIZED BED PYROLYSIS
CHAR & ASH
AGGLOMERATED ASH
FLUIDIZED BED GASIFICATION
AIR OR O2
STEAM
ASH PURGE
CATALYTIC HYDROTREATER
RECYCLE SOLVENT
H2
GAS

PRODUCTION OF LIQUID AND GASEOUS FUEL PRODUCTS FROM COAL OR THE LIKE

BACKGROUND OF THE INVENTION

This invention pertains to the conversion of coal or other solid carbonaceous material to hydrocarbon oils and gases, and more particularly to an improved process for the hydrogenation, hydrocracking, thermal cracking and gasification of coal or other solid carbonaceous materials.

While the invention may be used in the treatment of various types of solid carbonaceous materials, it will be discussed hereafter in connection with the treatment of coal, in which the invention provides particular advantages.

It has been known for several decades that pulverized coal can be converted to useful petroleum products by a large variety of gasification and liquefaction processes. Extensive research work has been done in connection with coal gasification and in connection with deep hydrogenation coal liquefaction in an attempt to produce liquid and gaseous fuel at reasonable cost. However, fuels produced by the prior art processes have been so expensive relative to fuels obtained from crude oil that production has been very low.

Two basic systems are commonly used for converting coal to liquid fuel. One involves gasification of the coal and subsequent conversion of the gas to oil or gasoline, for example by the Fischer-Tropsch procedure. The other involves mixing dry pulverized coal particles with recycled solvent oil to produce a slurry and passing the slurry with hydrogen through a high-temperature high-pressure reactor to effect hydrogenation and hydrocracking.

Almost all such systems for producing liquid fuel from coal include the manufacture of hydrogen or a mixture of hydrogen and carbon monoxide. Heretofore, the cost of producing the hydrogen has been excessive, and the hydrogen produced has not been used in the most effective manner.

In order to effect deep hydrogenation and effective hydrocracking, it has been common practice to employ catalysts, but these are costly and can be troublesome because of the problems of contamination, catalyst deactivation and catalyst loss.

For many years coking processes, such as delayed coking and fluid coking, have been employed in connection with carbonaceous feedstocks to produce coke and useful fuel products. These oil-refinery processes have required low-ash feedstocks to produce coke having acceptable ash contents. Excessive ash renders the coke unsuitable for electrode manufacture and drastically reduces its usefulness as a fuel.

The fluid coking process, for example, is used for upgrading low-value residual feedstocks to gas, oil, gasoline, by-product gas and coke. In a typical system the hot residuum feedstock is fed into the reactor vessel containing a bed of fluidized coke at a high temperature, such as 950° F. Coke is fed through a fluidized-bed burner unit operated at a higher temperature, such as 1100° to 1150° F., part of the coke is withdrawn from the burner unit to maintain the solid inventory, and part is recirculated to said reactor. A grinding technique may be employed in the reactor to keep the circulation coke from becoming too coarse and to maintain the desired particle size in the system. If desired large particles can be removed and replaced with small seed particles supplied by a coke particle attriting system in the reactor.

Vapor products from the reactor flow overhead through cyclone separators that remove entrained ash and coke particles and feed them back into the bed. A scrubber-fractionator tower is provided to remove residual entrained ash and coke particles from the reactor vapors and to condense the high boiling coker products. The lighter components proceed overhead from the scrubber to a conventional fractionation unit. The heavy products with the ash and coke particles are removed from the bottom of the scrubber and recycled to the reactor. The slurry recycle can, for example, amount to 20 to 40 percent of the residuum feed.

The fluid coking process is unsatisfactory for use with high-ash feedstock. As previously indicated, excessive ash in the coke is generally unacceptable. There is also a problem of fines build-up in the system and particle overloading of gas cyclones and downstream gas cleaning equipment. The carryover of char fines to the downstream gas processing can also reduce carbon conversion efficiency. Because of the various problems associated with entrained solids, most coal liquefaction processes require costly mechanical solids separation steps.

If desired, a fluid coking process of the type described above can be combined with coke gasification. For example, most of the coke can be fed to a Winkler or Winkler-type gasifier capable of converting 90 weight percent or more the coke to gas as in the so-called "Flexicoking" system. However, the carbon conversion utilization of a Winkler gasifier is relatively low and typically about 60 to 90 percent as compared to 99 percent or greater in the process of this invention. The systems which employ coke gasification in connection with fluid coking are designed for low-ash feedstocks because of the problems created by excessive ash.

The problem of providing a more economical process for converting coal to liquid and gaseous fuels has existed for many decades without a practical solution. Deep hydrogenation processes of various types have been proposed and have had various shortcomings. Most have involved use of expensive solids separations steps to eliminate solids remaining in the heavy coal extract prior to subsequent processing. Others have been inefficient or not fully satisfactory for other reasons. The present invention provides a practical solution to the problem.

SUMMARY OF THE INVENTION

The present invention involves a unique combination which is less complicated than most coal liquefaction processes and wherein the treating steps are so interrelated as to provide a high output at minimal cost with a very efficient use of hydrogen. The process of the invention eliminates the troublesome solids separation steps and permits efficient operation without expensive catalysts for the hydroextractor unit or the pyrolysis unit. The equipment is designed to obtain the maximum catalytic effect from the ash, which may be recycled to increase the hydrogen transfer. Otherwise, no catalysis is practiced on the coal or the coal extract.

The novel system of this invention employs a fluidized-bed char gasification unit with a unique ash agglomeration means. The gasification unit is constructed to cause continual accretion and agglomeration of the hot ash particles so that the fine particles are agglomerated to extinction. This eliminates the fines build-up problem normally associated with fluidized beds and permits efficient removal of the larger agglomerated ash particles.

In the preferred embodiment of the invention a hydrogen-donor solvent oil is mixed with dry powdered coal and passed with additional hydrogen gas through a high-temperature high-pressure hydroextractor. The light oil and gas is separated out, and the residual coal extract containing the solid particles and ash is subjected to vacuum flash distillation to recover more oil for use as the recycle solvent. The heavier coal extract is then passed to a fluidized-bed pyrolysis unit where the extract is subjected to thermal cracking and preferably some hydrocracking to recover more liquid fuel. The residual char and ash from the pyrolysis unit is then delivered to a high-temperature fluidized-bed char gasification unit wherein the char is reacted with steam and air or oxygen to produce fuel gas while generating heat. The ash is agglomerated and continually recycled back through the pyrolysis unit to provide a catalyst for enhanced liquid product yield and to transfer all of the heat required for the latter unit.

Agglomeration of the ash particles is effected by causing them to come together in an extremely hot zone where they are brought to their softening point and become sticky so that the particles accrete and stick together when they come into contact. In the preferred embodiment the gasification unit has a downwardly-converging perforated grid plate at the bottom of the fluidized bed and an elutriation leg of reduced diameter at the bottom of the grid plate. Air or oxygen, in addition to that supplied with the steam to the grid plate, is introduced at the top of the elutriation leg to provide a hot spouting zone of maximum temperature near the bottom of the grid plate. This zone causes continuous agglomeration of the ash particles and avoids the fines problems associated with conventional fluidized beds. Any fine ash that is carried over in the vapor or gas exiting the pyrolysis unit or the gasification unit is separated out in the gas cyclone and recycled to the gasification unit. When it reaches the bottom of the bed, it sticks to the agglomerates. With this agglomeration technique, particulate loading in the overheads leaving the pyrolysis unit or the gasification unit is greatly reduced.

BRIEF DESCRIPTION OF THE DRAWINGS

FIG. 1 is a schematic flow diagram on a reduced scale showing a preferred system for carrying out the process of the present invention.

DESCRIPTION OF THE PREFERRED EMBODIMENTS

Figure 2:
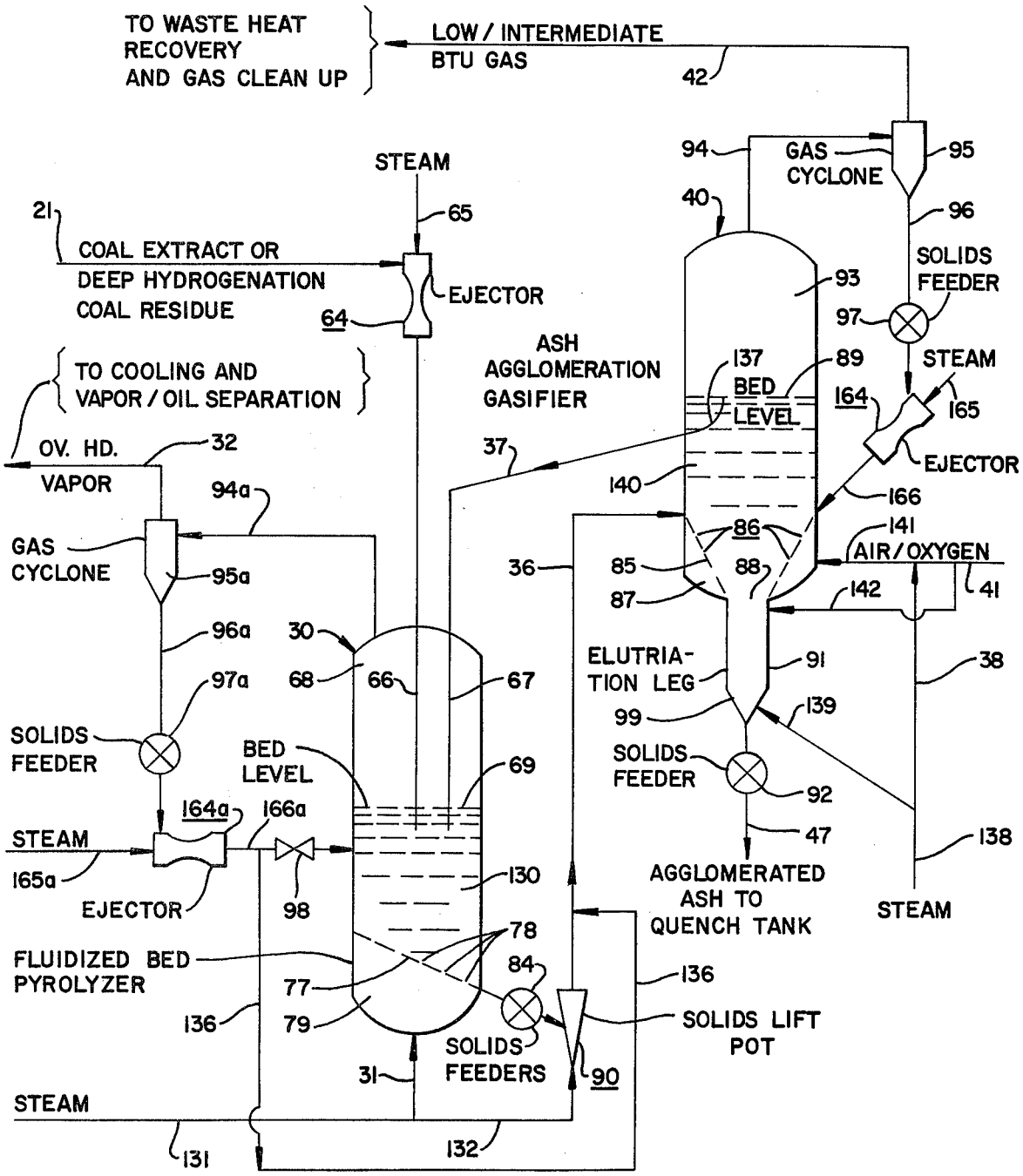
FIG. 2 is a partial schematic elevational view on a reduced scale showing a portion of an apparatus which can be employed in the system of FIG. 1.

Referring more particularly to the drawings, in which like parts are identified by the same numerals, FIG. 1 shows the basic element which can be used in carrying out the process of this invention, it being understood that the individual elements of the system may be of various constructions while still functioning in the required manner.

The major components of the preferred system shown in FIG. 1 include a hydrogenation extraction unit 10, a vacuum flash distillation unit 20, a fluidized-bed pyrolysis unit 30, a fluidized-bed gasification unit 40, and an optional catalytic hydrotreating unit 50. Auxiliary units in the system shown herein include a coal preparation unit 3, a slurry preparation unit 5, a slurry preheater 8, fractionating units 23 and 33, a liquid recovery unit 60, a steam-methane reforming unit 70, and an acid gas removal unit 80. Excluding the apparatus associated with the units 30 and 40, most of the individual components of the system can be of known or conventional construction and are, therefore, illustrated diagrammatically. FIG. 2 illustrates one embodiment of the preferred apparatus which can be employed in the system.

The system illustrated herein can be used to obtain liquid and gaseous fuel from various carbonaceous solid fuel materials containing volatile matter, such as bituminous or subbituminous coal, anthracite, lignite or peat, but is especially designed for deep hydrogenation of coal. Any rank coal may be used. The raw coal and/or other carbonaceous material is crushed, dried and classified to yield finely divided particles of small particle size (such as minus 50 or minus 100 Tyler mesh) with a low moisture content, preferably less than 3 percent by weight. The average particle size of the comminuted coal is usually less than 200 and preferably less than 100 microns.

As shown in the drawing, the raw coal from storage is fed through conduit 2 to the unit 3 where it is crushed to minus 100 mesh particle size, heated and dried to reduce the moisture content to approximately 2 percent by weight. The dried coal particles are fed through conduit 4 to a conventional slurry preparation unit 5 where they are blended with a naturally derived coal solvent introduced at conduit 28. The amount of dry particles is 30 to 50 percent of the blend. The typical slurry blend is about 40 percent by weight coal particles and about 60 percent by weight solvent. The slurry blend is pumped at the desired high pressure by a pump 7 and hydrogen is added to the slurry from conduit 57 to provide a three-phase mixture which flows through conduit 6 to a conventional slurry preheater 8 where the mixture is heated to a high temperature, such as 800° F. to 875° F. (about 425° to 470° C). The hydrogen is introduced at a high pressure from a suitable compressing means, such as a compressor 157.

The three-phase mixture flows from the preheater 8 through conduit 9 to the bottom of a hydrogenation extraction unit 10 which operates at a high pressure, such as 100 to 200 atmospheres, preferably in the range of from about 1500 to about 2500 pounds per square inch gage, and a high temperature, such 2500 pounds per square inch gage, and a high temperature, such as 800° to 875° F. (about 425° to 470° C.). The most reactive coal compounds will be hydrocracked in this unit, and 85 to 95 percent or more of the MAF (moisture- and ash-free) coal will be converted to liquid and gaseous products. The extractor 10 may be of conventional construction and may be of various types. If one extractor is used, it may be of the conventional plug-flow type. Two or more extractors can be used and are advantageous when recycle ash is added to the slurry (from conduit 59) since this permits staged temperature control to maximize liquid yields.

As herein shown there is provided either a single hydroextractor 10, or a pair of identical hydroextractors 10 and **10*a* arranged in series. The slurry flows upwardly from conduit 9 to extractor 10 and thereafter flows either through conduit 11 to a conventional separator 12 or through conduit 11a and extractor 10*a* to said separator. The extractors may either be of the plug-flow type, if one extractor 10 is used, or of the conventional back-mix type with a reverse lift leg to keep the slurry circulating within the extractor, if series extractors are used with ash addition. The three-phase slurry with or without the recycled ash enters the bottom of the extractor 10 and flows upwardly. The upward velocity is sufficiently high to carry all suspended particles through conduit 11 to separator 12. If recycled ash is added to the slurry, then the back-mix series reactor arrangement is employed as previously described. The three-phase slurry containing recycled ash enters the bottom of each extractor 10 and 10***a* and is continuously circulated within the extractor is shown by the arrows in the drawings. The gas hold-up phenomenum, at the high pressures involved, supplies adequate driving force for circulation, but it will be understood that auxiliary means may also be provided.

The upward velocity is such that all undissolved coal particles are carried upward through the extractor and exit with the dissolved coal (extract) and solvent at the top of the extractor so that such particles are delivered to slurry conduit 13 after passing through the vapor/liquid-solids separator 12.

The hydroextractor is operated under suitable hydrocracking conditions and is preferably operated at those conditions which maximize liquid yields. The extractor should be capable of dissolving 90 to 95 percent by weight or more of the MAF coal and transferring 4 weight percent or more of hydrogen to the MAF coal. The amount of hydrogen transfer depends on the operating conditions of the hydroextractor, the amount of catalysis supplied by the catalytic hydrotreater or recycled ash, and the residence time of the slurry in the hydroextractor.

If recycle ash is added to the slurry from conduit 59 to serve as a catalyst, the hydrogen transfer during staged back-mix hydroextraction in units 10 and 10*a* should be in the range of 4 to 6 percent by weight when the recycled solvent from conduit 25 is not hydrotreated (for example, when unit 50 is omitted), the higher the hydrogen transfer, the greater the overall liquid yields from the process. If the solvent from conduit 25 passes through unit 50 to provide a hydrogen-donor solvent, the hydrogen transfer should still be at least 4 weight percent when employing plug-flow hydroextraction with only one extractor 10, even if the recycled ash is omitted.

After the three-phase mixture flows through the hydroextractor unit, it enters a conventional gas-liquid-solid separator 12. The separator may be of conventional construction and is preferably a tank with no internal moving parts. The produced volatile light oil, gas and make water exits from the separator through conduits 14 and 15 to the gas-oil recovery system described hereinafter. The heavy coal extract from the separator exits through conduit 13 and is pressure let-down to a vacuum flash distillation unit 20.

Since the make light oil and gas is at elevated pressure, a conventional power recovery train may be employed in the pressure let-down. As herein shown, conventional power units 16 and 17 are provided in conduits 13 and 14, respectively, for power recovery.

The distillation unit 20 is of conventional construction and is usually operated at a relatively high temperature, such as 700° to 750° F. (about 370° to 400° C.). It operates at a pressure below 1 atmosphere and usually about 2 pounds per square inch absolute. In the system shown, the unit 20 separates the oil with a boiling range below 1040° F. (560° C.) from the heavier extract at a higher boiling point. The flashed oil and dissolved gas pass through conduit 22 to a conventional fractionation unit 23, and the vacuum still bottoms exit through conduit 21 to a pyrolysis unit 30.

The vacuum distillation unit 20 is capable of reducing the solvent content of the extract in conduit 21 to a very small percentage less than 5 percent, such as 0 to 2 percent by weight. The vast majority of the solvent from conduit 13 is delivered through conduit 22 to fractionation unit 23 which separates out the oil boiling in the range of 450° to 650° F. (about 230° to 340° C.) and delivers it to conduit 25 for recycling to the unit 5. The remaining liquid is delivered through conduit 24 to the liquid recovery system.

Part or all of the recycle solvent for unit 5 can be provided by the fractionation unit 23. If desired, part of the recycle solvent can be obtained by fractionation from the hydroextractor overheads (conduit 14) as well as from the vacuum flash still overheads (conduit 22).

The solvent preferably boils in the range of 450° to 650° F. (about 230° to 340° C.), but this can vary somewhat. The fractionation needed to provide a solvent with the desired boiling range can be carried out at unit 60 and/or unit 23 or elsewhere in the oil recovery systems. If desired, one fractionator can handle the oil from conduit 15 as well as conduit 22. For example, an optional conduit 72 can be provided between the recovery unit 60 and conduit 22 to deliver part of the oil from unit 60 to the fractionator 23 under control of the optional valve 75. The latter can also be used to cut off the flow.

The pyrolysis unit 30 employs a fluidized bed of hot ash and char. Preheated steam from conduit 31 is injected upwardly into the fluid bed as the fluidizing medium, whereby hydrogen required for the hydrogenation and hydrocracking reactions is produced by way of the steam-carbon and water-gas-shift reactions. No air or oxygen is required, and direct heating is not necessary because the heat requirements are supplied by hot recycled ash from the char gasification unit 40.

The coal extract or slurry is fed from conduit 21 into a hot bed of fluidized ash agglomerates in the unit 30. The reactions are primarily thermal cracking with slight amounts of hydrogenation and hydrocracking. The pyrolysis unit 30 operates at a temperature from about 900° F. to about 1200° F. (about 480° to 650° C.) and preferably at least 925° F. (about 500° C.). The pressure is preferably below 2 atmospheres, usually somewhat above atmospheric pressure and can, for example, be 15 pounds per square inch gage. The product coke coil and gas exits at the top of the unit through conduit 32 for delivery to the oil recovery system. For example, it may be delivered to the unit 60 or to a conventional fractionation unit 33 which delivers a naphtha fraction to conduit 34 and the remaining gas oil fraction to conduit 35.

Char and ash from the pyrolysis unit 30 is continually discharged through conduit 36 to the ash-agglomerating char gasification unit 40, which has a fluidized bed of char and ash maintained at a high temperature below the ash fusion temperature, such as 1800° to 2400° F. (about 980° to 1320° C.) and preferably 1900° to 2000° F. (about 1040° to 1090° C.). The pressure in the unit 40 is below 2 atmospheres and preferably approximately the same as in unit 30. Preheated steam is injected upwardly into the fluidized bed from conduit 38 to act as a fluidization medium, and oxygen, air or other oxygen-containing gas is introduced from conduit 41 to provide an oxidizing medium. The char is reacted with the steam and oxygen to produce a low BTU fuel gas which exits from the top of the unit through conduit 42. Agglomerated ash is continually removed from the bottom of the gasifier through conduit 47 and can be disposed of in a landfill, for example.

The char gasification unit is specially constructed to effect agglomeration or accretion of the ash particles as described in more detail hereinafter. The agglomerated ash is continually recycled through conduit 37 from the gasification unit 40 to the pyrolysis unit 30 and serves as a catalyst to enhance the liquid product yield. The recycling of the ash removes heat produced by the exothermic reaction in unit 40 and transfers that heat to the pyrolysis unit 30 to maintain the desired temperature for pyrolysis.

The optimum temperature in the bed of the gasification unit 40 depends on the ash eutectic fusion temperature and is somewhat below said fusion temperature, usually in the range of 1900° to 2200° F. (about 1040° to about 1200° C.).

The beds of ash and char in the units 30 and 40 are ebullated or fluidized by forcing the steam, air, oxygen and/or other suitable fluidizing gas upwardly through the bed at a velocity sufficient to suspend the particles. For example, the upward flow of gas through each bed can expand the bed so that is occupies at least 10 or 20 percent greater volume than the settled state of the bed.

When the gasification unit is operated in the normal manner with air introduced through conduit 41, a low BTU fuel gas is produced of approximately 120 to 150 BTU/scf. The BTU content can be increased by increasing the percentage of oxygen present in the incoming air or gas. If manufactured oxygen is injected through conduit 41, an intermediate BTU fuel gas can be produced of approximately 300 BTU/scf. The latter is suitable for production of hydrogen in a hydrogen manufacturing unit and can be delivered from conduit 45 as a fuel source. However, it is usually more practical to introduce air at conduit 41 and to employ the high BTU fuel gas from unit 80 for the unit 70. Low BTU fuel gas can be delivered from conduit 45 to unit 70 as a fuel source for the reformer heaters.

As herein shown, the gas from the liquid recovery unit 60 is delivered through conduits 18 and 19 to a conventional acid gas removal unit 80. The sulfur containing gases are removed through conduit 81 to the sulfur and tail gas plant 82 and the high BTU gas, is discharged through conduit 54 for upgrading to synthetic natural gas, as a chemical synthesis gas feedstock, or as a fuel. A major portion of this gas is fed through conduit 55 to a conventional steam-methane reforming unit 70, where steam is introduced to convert the fuel gas to carbon dioxide and produce the hydrogen required for hydroextraction and for hydrotreating the recycle solvent, if a hydrotreating unit is employed.

In most deep-hydrogenation coal-liquefaction processes, the provision of adequate amounts of hydrogen is a major expense. In the process of the present invention the staged mode of coal treating involving hydroextraction, pyrolysis and char gasification provides for very efficient use of hydrogen. The system does, however, require generation of a considerable amount of hydrogen gas in unit 70 for use in the hydroextraction step. As herein shown, this hydrogen gas flows through conduit 56 to conduit 52 for delivery to the hydrotreater 50 and to conduit 57 for delivery to the slurry in conduit 6. More efficient use of hydrogen is achieved by continually recycling part of the hydrogen-rich gas from conduit 19 through by-pass conduit 58 to conduit 57 and from conduit 53 through by-pass conduit 73 to conduit 52, should hydrotreating be included.

Rapid and deep coal hydrogenation may be achieved in an economical manner by recycling ash through conduit 59 to the slurry preparation unit 5 to serve as a hydrogenation catalyst. Catalyst deactivation is not a problem because of the continuous supply of fresh material at conduit 59. The ash catalyst is carried with the slurry through units 10, 20 and 30 and with the char back to unit 40. Controlled recycled ash quantities should not significantly alter operation of the system and will improve overall liquid yields. Catalysts, other than ash, can be used in the hydroextraction steps but are undesirable because of excessive cost and other problems, such as catalyst deactivation and catalyst recovery. The process of the present invention can achieve effective hydrogenation of the coal without the use of manufactured catalyst.

It will be understood that the hydrotreater 50 can be omitted if recycled ash is employed in the system illustrated in the drawing. However, more rapid and deeper coal hydrogenation can be achieved when a hydrogen-donor recycle solvent is provided in conduit 28, whether or not ash is added to the slurry. The use of the hydrotreater 50 is, therefore, important when trying to improve the liquid yield of the system. It is particularly important when non-catalytic hydroextraction is carried out with a single plug-flow hydroextractor 10.

The hydrotreating step at unit 50 may be carried out with a conventional hydrotreater and is preferably a catalytic process. The catalyst life is good with a conventional catalyst since the catalyst contacts fractionated oil only and not the coal particles. The hydrotreater is preferably operated at a high temperature, such as 650° to 750° F. (about 340° to 400° C.) and at a high pressure, such as 80 to 200 atmospheres (preferably 1200 to 2000 pounds per square inch). For example, the unit 50 preferably operates at 700° F. (370° C.) and 1500 pounds per square inch gage and produces a hydrogen-donor oil containing 7 to 10 weight percent or more of hydrogen.

While it is possible to supply a large part of the hydrogen needed for hydrogenation from the recycle solvent in conduit 28, it is preferable to add the remaining required hydrogen to the slurry by direct supply of hydrogen gas at conduit 57. The provision of such hydrogen gas plus the hydrogen-donor recycle solvent makes it possible to obtain maximum yields from the system. However, it is not always necessary to pass all of the recycle solvent from conduit 25 through the hydrotreater unit 50. Part of such solvent may bypass the unit through conduit 76.

The amount of solvent which is hydrotreated depends on the hydrogen transfer requirements at the hydroextraction unit 10 and may be selected to provide the coal extract with a Conradson carbon number most suitable for the subsequent pyrolysis and gasification steps. The main purpose of the hydroextraction step at unit 10 is to reduce the Conradson carbon content to less than 40 percent by weight (for example, to between 30 and 40 percent) so that the pyrolysis unit 30 produces good liquid yields. Optimum hydrogen transfer during hydroextraction makes it possible for the units 30 and 40 to provide the system with a high efficiency so that oil and fuel gas are produced in the most economical manner.

It will be apparent that the oil recovery system employed in the practice of the present invention may be of various types and may be somewhat different from that shown in the drawings. The oil recovered from hydroextraction, vacuum flash distillation and extract pyrolysis in units 10, 20 and 30 and delivered to the oil recovery apparatus can be processed in various ways. Part of it can be fractionated to provide the recycle solvent. It may also be upgraded by processing through a conventional hydrogenation unit to hydrogenate gum-forming compounds or sent to a conventional hydrocracker to obtain any molecular weight range of desired products. As herein shown, the oil recovered from units 10 and 20 is processed separately from the oil recovered by extract pyrolysis from unit 30, but separate treatment is not essential. As shown the liquid from conduits 14 and 24 is delivered by conduit 15 to the liquid recovery unit 60 which separates the principal constituents and discharges light oil from conduit 61, phenols and cresylic acid from conduit 62, and waste water from conduit 63.

In the system shown herein the three gas streams at lines 18, 42, and 53 require cleanup. The high BTU gas and hydrotreating off gas require hydrogen sulfide removal which is effected in a conventional manner in units 80 and 82. The low BTU fuel gas at line 42 requires removal of both hydrogen sulfide and particulates, which is effected in unit 43. The sulfur compounds are discharged to conduit 44 and combined with the discharge from unit 82 at conduit 83. The low BTU gas is discharged to conduit 45, and the residual particulate material is removed from the bottom of the unit at conduit 46.

The fuel gas from conduit 45 can be delivered to a gas holder for use as a source of fuel for heating or for producing steam for units 8, 20, 23, 30, 40, 50, 60 and 70. As shown there is provided a branch supply conduit 29 which delivers the fuel gas from conduit 45 through branch conduit 26 to the distillation unit 20, through branch conduit 27 to the fractionator 23, through branch conduit 48 to the drying apparatus of unit 3 through branch conduit 49 to the preheater 8, through branch conduit 51 to the hydrotreater 50, and through branch conduit 71 to the steam-methane reforming unit 70. If pure oxygen, instead of air, is added to the char gasifier at conduit 41, the fuel gas could be used in place of the high BTU gas as a feedstock for the hydrogen plant. With this approach the steam-methane reformer 70 could be replaced with a hydrogen plant to produce hydrogen from a carbon monoxide-hydrogen feedstock rather than primarily a methane feedstock.

The overall system of the present invention has been described in connection with FIG. 1 which illustrates basic features of the invention, and it will be understood that the units 30 and 40, for example, may be constructed in different ways to carry out the process described above. FIG. 2 illustrates a form of apparatus which is presently preferred for carrying out the invention. As indicated in FIGS. 1 and 2 the coal extract or deep hydrogenation coal residue in the form of a slurry containing solid particles of ash and carbonaceous material is fed to the pyrolysis unit 30, portions of the char and ash particles are continually fed from the fluidized bed of the unit 30 to the fluidized bed of the gasification unit 40, and a portion of the char and agglomerated ash particles are continually recirculated through conduit 37 to the bed of the pyrolysis unit.

As shown in FIG. 2, which is a schematic side elevational view, the coal extract or slurry is pumped downwardly into the bed 130 of the pyrolysis unit by a steam-jet ejector unit 64 which is supplied with high pressure steam by a vertical steam conduit 65. The steam-jet ejector 64 may be of a conventional type and is preferably a single-stage ejector having a diffuser tube and a steam nozzle directing a steam jet through the narrow throat of the diffuser tube, whereby the steam entrains the slurry surrounding the steam nozzle and delivers the solid particles and liquid downwardly under pressure through the vertical conduit 66 to the upper portion of the fluidized bed 130, preferably a short distance below the upper surface 69 thereof. The steam has a high velocity as it passes through the throat of the diffuser tube, its narrowest portion, and causes the diffuser to act as a compressor so that the material is forced downwardly under pressure through the conduit 66. The ejector functions in the usual manner as a suction pump to draw the material from conduit 21. The conduits 65 and 66, the steam nozzle and the diffuser tube are preferably coaxial and have a common vertical axis. This vertical arrangement adds the force of gravity to the pressure exerted by the ejector 64 to avoid clogging of the passages and facilitates pumping of a heavy coal extract containing a substantial amount of solid particles so that the equipment can function reliably without preliminary mechanical separation and removal of solid particles.

The pyrolysis unit 30 may be of a standard type, and the bed 130 thereof may be fluidized in the conventional manner by forcing steam and/or other non-oxidizing fluid upwardly through the bed at a rate of flow sufficient to cause the desired ebullation. Improved results are achieved by providing a flat inclined perforated or grid-like plate 77 having a multiplicity of perforations 78 closely arranged throughout its length and width for directing the fluidizing gas upwardly from the pressurized plenum chamber 79 at the bottom of the vessel to the bed 130 of ash and char particles above the plate. With this slanted arrangement the ash and char particles on the plate 77 readily flow by gravity from the bottom of the bed to the solids feeders 84. The high gas pressure in the plenum chamber 79 prevents the particles of the bed from falling into said chamber. This is a very reliable system which avoids clogging or plugging of the openings 78 and which facilitates continuous circulation in the bed and continuous movement of particles out of the bed.

The fluidizing medium for the unit 30 is preferably steam which is fed at high pressure through supply conduit 131 and the vertical conduit 31 to the lower chamber 79 of the pyrolysis unit. The pressure in the chamber 79 is maintained high enough to effect the desired rate of flow of steam upwardly through the bed. Part of the steam from conduit 131 passes through branch conduit 132 to a solids lift pot 90.

The bed 140 of ash and char particles in the char gasification unit 40 may be fluidized in a generally similar manner, but the fluidizing medium includes, in addition to the steam, an oxygen-containing gas, such as air, oxygen or oxygen-enriched air. The percentage of oxygen employed in the fluidizing gas can be varied, and an increase in the concentration of oxygen increases the BTU content of the fuel gas produced by the unit. Basicly what is required is an oxygen-containing gas, such as a mixture of nitrogen or other inert gas and at least 15 percent and preferably at least 20 percent by weight of oxygen. The gas mixture can contain a major amount by weight of oxygen, but it is usually preferred not to use pure oxygen or manufactured oxygen because of the expense of producing it.

FIG. 2 shows an ash-agglomerating char gasification unit 40 of a unique construction which make it possible to operate with maximum efficiency and to continually remove the undesired ash particles in the most effective and economical manner. As shown the unit 40 has a frusto-conical or funnel-shaped perforated grid-like plate 85 with a multiplicity of closely arranged perforations or openings 86 throughout the length and circumference of the plate for directing the fluidizing gas upwardly through the bed 140. A pressurized annular plenum chamber 87 is formed between the plate 85 and the surrounding wall of the vessel to receive the steam and the air and/or oxygen.

The plate 85 may be formed of a heat-resistant or refractory material, and ceramic pipes or the like may be provided at the openings 86 to direct the gases upwardly from the plenum chamber 87. The construction is such that char and ash agglomerates do not enter the plenum chamber. This avoids pluggage problems during shut down and startup.

In accordance with the invention, the fine ash particles are agglomerated and caused to grow in size and weight by bringing them into contact with other ash particles in a high-temperature accretion zone where the temperature is either near the ash fusion temperature or high enough to fuse or soften the outer surface portions of the ash particles so that they become sticky or capable of adhering to other particles. While excessive temperature and unwanted fusion in the fluidized bed 140 can interfere with fluidization of the bed, said accretion zone is preferably located in the bed rather than in a location spaced from the bed.

The invention provides elutriation means for washing the agglomerated ash particles with steam or other gas to separate the larger heavier ash particles from the smaller ash particles and to recirculate the smaller particles. Such means is preferably incorporated in the gasification unit rather than being located outside of said unit and is preferably located at or adjacent said accretion zone.

As herein shown, the lower part of the vessel of the unit 40 of FIG. 2 has a reduced diameter to provide a vertical cylindrical elutriation leg 91 having a diameter corresponding to that of the bottom end of the downwardly converging plate 85. The plate causes the ash particles to converge or come together at the throat 88 formed at the top of the leg 91. As shown the leg has a conical bottom portion 99 for directing the ash particles downwardly to a solids feeder 92 located in the purge conduit 47.

Air or oxygen is supplied under pressure from the supply conduit 41 through the conduit 141 to the plenum chamber 87 and through the branch conduit 142 to the top portion of the elutriation leg 91 adjacent the throat 88 as shown in FIG. 2. High pressure steam is supplied from supply conduit 138 to conduit 38 and branch conduit 139. The steam from conduit 38 passes through conduit 141 to the plenum chamber 87. The mixture of steam and air or oxygen in the plenum chamber is at a high pressure such that the gases passing through the openings 86 to the bed 140 have a rate of flow sufficient to provide the desire ebullation of the bed.

FIG. 2 illustrates the preferred arrangement wherein the char gasification unit 40 is at a higher elevation than the pyrolysis unit 30 or its bed 130. This arrangement permits gravity flow of the extremely hot agglomerated ash and char particles through the recycle conduit 37. As herein shown the recycle conduit 37 has an upper portion 137 with its inlet end located at the top surface 89 of the bed so that the overflowing particles of the bed enter the conduit 37 and flow downwardly by gravity out of the bed. As shown the intermediate portion of the conduit 37 is downwardly inclined to facilitate gravity flow and has a vertical leg portion 67 which discharges into the bed 130 a short distance below the surface 39 thereof. Substantially all of the conduit 37 can be steeply inclined to facilitate rapid downward gravity flow of the hot agglomerated ash and char particles.

Because the pyrolysis unit 30 is at a lower elevation, it is necessary to pump the char and ash particles upwardly from the unit 30 to the unit 40. This is accomplished by use of steam pressure to force the particles upwardly through the conduit 36 to the bed 140. Pumping can be effected using equipment similar to a steam jet ejector, but it is preferable to employ a special solids lift pot 90. As herein shown, said lift pot has its axis in a vertical position in alignment with the vertical portions of conduits 132 and 136 and is located to receive the solid particles fed downwardly from the feeding means 84. The high pressure steam from conduit 132 forces the solid particles of char and carbon-coated ash upwardly from the pot 90 through the conduit 36 to the bed of the gasification unit 40. Sufficient steam pressure is provided to assure flow of the solid particles into the bed at the desired rate. The discharge end of the conduit 36 is preferably located at or slightly above the upper end of the tapered perforated plate 85, as shown for example in FIG. 2.

The extremely fine solid particles from the fluidized beds in units 30 and 40 which enter the upper chambers 68 and 93 of the unit and which are carried out with the overhead gases or vapors may be separated out and collected for recycling by various means. As shown the gases leaving the chamber 93 of the gasification unit 40 pass upwardly through conduit 94 to a conventional gas cyclone 95 which separates the solid particles from the gas which exits through conduit 42. These solid particles fall by gravity through vertical conduit 96 to a solids feeder 97 which delivers the particles to a conventional steam ejector 164 or to other suitable pumping means. The ejector 164 may be generally the same as ejector 64 and has a steam nozzle receiving high-pressure steam from conduit 165 and a diffuser tube coaxial with the conduit 165 and said nozzle for delivering the solid particles through discharge conduit 166 into the bed 140. The discharge end of the conduit 166 is located near and preferably at the top of the tapered perforated plate 85, as shown in FIG. 2, and the conduit 166 is downwardly inclined, preferably at a steep angle, such as 45° or so, whereby the particles flow downwardly at a high velocity. The ejector 164 applies positive pressure to the particles at conduit 166. The rapidly flowing particles entering the bed 140 at the top of the plate 85 tend to move the particles at the bottom of the bed downwardly toward the throat 88. This particular arrangement is advantageous in maintaining the desired circulation of the particles. This circulation can also be aided by the discharge of particles from conduit 36 at a substantial velocity. It will be understood that the discharge end portion of the conduit 36 may be downwardly inclined generally the same as conduit 166 if better circulation is desired.

The elements 94, 95, 96 and 164 associated with the gasification unit effect continual recycling of fine ash particles which are agglomerated to extinction in the unit 40 so that there is no problem of fines build up. The pyrolysis unit 30 employs similar element **94*a*, 95*a*, 96*a* and 164*a* to effect recycling of extremely fine solid particles from the unit 30. As shown the overhead vapors from the upper chamber 68 of the pyrolysis unit containing entrained fine solid particles are fed upwardly through the conduit 94*a* to the gas cyclone 95*a* where the particles are separated out by centrifugal force. The vapors are removed through conduit 32 and the solid particles move downwardly through conduit 96*a* and the solids feeder 97*a* to the inlet end of the steam jet ejector 164*a*, which may be identical to the ejector 164. Steam under pressure from the conduit 165*a* is discharged from the steam nozzle through the throat of the diffuser tube so as to entrain the solid particles and force them under pressure through the conduit 166*a*. With the valve 98 in the open position, these particles flow to the upper portion of the fluidized bed 130 as shown in FIG. 2 and are eventually caused to be agglomerated in the unit 40**.

The solid particles from the cyclone **95*a* are preferably returned to the gasification unit 40 directly rather than directly to the unit 30. In the arrangement shown herein this requires lifting the particles discharged from cyclone 95*a*, but it will be apparent that other arrangements could be employed and that the cyclone 95*a* could be at a higher elevation, if desired. One way of returning fine particles to the unit 40 is to pump them by means of a steam jet ejector or the like so that they are forced into the unit 40 and, if necessary, lifted to a higher elevation. A number of different arrangements could be provided. As herein shown, a valve 98 is provided for optional cut off of flow to the bed 130 from conduit 166*a*, and a bypass conduit 136 is provided to carry the fine particles from the ejector 165*a* to the conduit 36. With this arrangement the steam pressure in conduit 136 forces the fine particles to move to the gasification unit 40 at a substantial velocity. The conduit 136 may have various locations and may discharge into the conduit 36 or directly into the bed 140. The advantage of feeding the fine particles directly to the gasifier 40 is that the particles are readily agglomerated and there is less chance of a build up of fine particles in the bed of unit 30**.

The diagrammatic U-shaped showing of the conduit 136 in FIG. 2 is merely for convenience, it being understood that said conduit can be arranged in various ways to bypass the unit 30 and may, for example, extend in a straight line from the ejector **164*a* to the bed 140 or in a straight horizontal or upwardly inclined line directly from said ejector to the line 36**.

In the preferred system the char fines carried over with the gas from unit 30 and separated out by the gas cyclone **95*a* will be reintroduced to the unit 30 during startup with the valve 98 open. After startup, the valve 98 is preferably closed and the fines from the cyclone 95*a* are injected through line 136 to the steam lift line 36**.

The fluidized bed char gasification unit 40 is constructed to effect agglomeration or accretion of the fine ash particles to extinction and continually eliminates the excess fine particles so that the apparatus can function for an indefinite period of time without a buildup of fine particles. Agglomeration in the unit 40 is effected by introducing enough air or oxygen at line 142 to create a hot spouting zone of maximum temperature in the vicinity of the throat 88. The temperature in this zone can be maintained at a point where the ash particles are softened or made sticky at the outer surfaces so that they accrete or agglomerate near the throat 88. The remainder of the fluidized bed 140 above the spouting zone at throat 88 is at a somewhat lower temperature and below the fusion point of the ash so that the bed can continue to ebullate in the desired manner without fusion and accretion of the particles. By proper control of the supply of oxygen and steam it is possible to maintain the proper temperatures in the bed, and by proper control of steam and air flow the bed can be fluidized and suspended in the desired manner.

The amount of steam introduced through line 139 to the elutriation leg 91 is such that the central portion of the bed 140 at the hot spouting zone of the throat 88 is supported by the steam flow in said leg. This flow is maintained high enough to support the smaller lighter agglomerated ash particles so that they are caused to move upwardly toward the top of the bed and the recycle conduit 37. However, the force of the steam in the leg 91 is such that the larger heavy agglomerated ash particles can move downwardly under the force of gravity to the bottom portion 99.

The steam from conduit 139 cools the heavy agglomerates in the bottom portion of the leg 91 to a substantially lower temperature, such as 1200° to 1400° F., before the bottom solids feeder 92 delivers them to the quench tank. The retention time in the elutriation leg 91 not only allows for steam cooling of the agglomerates but also provides additional steam-carbon reactions to further reduce the carbon content of the ash, thereby yielding agglomerates with lower carbon content than conventional fluidized beds. The carbon content of the ash removed through conduit 47 may be reduced to 5 to 10 weight percent of the ash or lower so that there is 99 weight percent or greater conversion of the feed carbon.

The equipment of FIG. 2 may be operated in such a manner as to effect continual removal of heavier agglomerated ash particles through conduit 47 and continual agglomeration of the very fine ash particles in the hot spouting zone at 88 so that the fine ash particles are continually agglomerated to extinction.

The removal of the heavier particles by the solids feeder 92 may be either continuous or interrupted, and the unit 40 may be purged whenever it is desired to remove more of the ash. The apparatus of FIG. 2 is very stable and reliable, and fines can be reduced to a minimum because they are continuously being eliminated by agglomeration.

In the process of this invention the char fines carry over from conduits 94 and **94*a* to downstream gas processing is greatly reduced compared to conventional fluid beds, the particle loads to the gas cyclones 95 and 95*a*** are reduced, and overall carbon conversion efficiency is maximized. In a typical fluidized bed, there is a build-up of fine particles which overloads the gas cyclones and results in substantial fines carry over to downstream processing and lower efficiency.

The ash agglomeration system of FIG. 2 is also highly advantageous because it causes the lighter agglomerated ash particles to move upwardly from the hot agglomeration zone adjacent throat 88 to the top of the bed 140 and causes them to be recycled through conduit 37 to the reaction zone in the bed 130 where these agglomerated particles serve to catalyze the reactions. The catalytic action of the agglomerated ash particles improves the efficiency of the pyrolysis unit 30. The agglomerated ash particles may also be delivered to the conduit 59 so as to provide an effective catalyst for the hydroextraction units 10 and 10*a*.

The system described above and shown in FIGS. 1 and 2 can convert a relatively high percentage of coal to oil and fuel gas as indicated by the example below which illustrates how a plant can be operated in accordance with one embodiment of the invention using a Kentucky #11 coal.

This coal can, for example, have a heating value of almost 13,000 BTU per pound and an ultimate analysis generally as follows:

| Component | Weight % Feed Coal |
|---|---|
| $H_2O$ | 1.58 |
| Ash | 9.39 |
| C | 70.96 |
| H | 5.04 |
| N | 1.27 |
| S | 3.59 |
| O | 8.17 |

Particles of such coal having a particle size of minus 100 Tyler mesh can be mixed with a hydrogen-donor solvent in unit 5 and pumped through either a single plug-flow hydroextraction unit 10 or back-mix hydroextraction units 10 and 10*a* at a pressure of 1500 pounds per square inch gage while the temperature in each unit is around 800° F. (about 430° C.). The heavy coal extract discharged through conduit 13 would have a Conradson carbon weight percent less than 40. The hydroextraction units can be operated so that upwards of 95 weight percent of the MAF coal will be dissolved.

The vacuum flash distillation unit is operated at a pressure of 2 pounds per square inch absolute and a temperature of 700° to 750° F. (370° to 400° C.) to separate the oil with a boiling point less than 1040° F. (560° C.) from the heavier extract (+1040° F, +560° C.) which flows to the pyrolysis unit 30. The latter is operated at a pressure of 15 pounds per square inch gage and a temperature of 925° F. (about 500° C.) while the char gasification unit 40 is operated at the same pressure and at a temperature of 2000° F. (about 1090° C.). Air is supplied to conduit 41 of the gasifier so that a low BTU fuel gas is discharged at conduit 42.

The catalytic hydrotreater may be of a conventional fixed-bed type and is operated at a pressure of 1500 pounds per square inch gage and a temperature of 700° F. (370° C.). The recycle solvent supplied through line 25 has a boiling range from 450° to 650° F. (about 230° to 340° C.). Relatively large volumes of oil are recycled as indicated hereinafter.

Table 1 indicates the estimated production and material flow in a given period of time as applied to the illustrated flow diagram.

Table I

| | | |
|---|---|---|
| coal | conduit 4 | 100 tons |
| gas | conduit 18 | 11.9 tons |
| slurry | conduit 13 | 280.7 tons |
| distillate | conduit 22 | 224.4 tons |
| coal extract | conduit 21 | 56.3 tons |
| recycle solvent | conduit 25 | 200 tons |
| ash and coke | conduit 47 | 12.3 tons |
| naphtha | conduit 34 | 4.5 tons |

Table I-continued

| | | |
|---|---|---|
| gas oil (middle oil) | conduit 35 | 9.0 tons |
| light oil | conduit 61 | 27.85 tons |
| phenols and acid | conduit 62 | 0.35 tons |
| waste water | conduit 63 | 7.3 tons |
| sour gas | conduit 53 | 2 tons |
| gas | conduit 55 | 10.3 tons |
| high BTU gas | conduit 54 | 3.0 tons |
| sour gas | conduit 81 | 3.1 tons |
| sulfur | conduit 83 | 2.0 tons |
| sulfur | conduit 44 | 0.6 tons |

In a system of the type illustrated in the drawings, it is estimated that net fuel yields will be generally in excess of those given in Table II below.

Table II

| Component | API | Wt. % MAF Coal |
|---|---|---|
| $C_1$–$C_4$ (hydrocarbons)* | — | 3.4 Net |
| Light Naphtha (60° F–350° F) | 45 | 4.7 |
| Coker Naphtha ($C_4$–430° F) | 55 | 5.1 |
| Distillate (350–550° F) | 17 | 5.8 |
| Fuel Oil (550–800° F) | −3 | 3.1 |
| Coker Gas Oil (430–950° F) | 25 | 10.1 |
| Heavy Oil (800–1040° F) | −14 | 18.4 |

*Net fuel yield after satisfying hydrogen reformer requirements.

In addition to above yields, there will be a yield of low BTU fuel gas from unit 43 conduit 45 with an estimated equivalent heating valve of almost 2500 BTU per pound of feed coal. This gas is used for process heat requirements.

With high hydrogen transfer rates in the hydroextraction unit, the yields of liquid fuel should be at least half the weight of the MAF coal or somewhat greater. For example, a total hydrogen transfer of 4.1 weight percent can be achieved by a 2.1 weight percent hydrogen transfer to hydroextraction plus a 2.0 weight percent hydrogen transfer to the recycle solvent at unit 50. With greater hydrogen transfer even greater liquid yields may be achieved.

The hydrogen transfer depends on the operation of the hydroextraction unit as well as the method of introducing hydrogen. A hydrogen transfer of at least 4 weight percent of the MAF coal may be achieved using plug-flow hydroextraction with a single hydroextraction unit, but this will require use of a hydrotreating unit 50 to add hydrogen to part of all of the naturally derived recycle solvent.

If staged back-mix hydroextraction is used with recycled ash, it should also be possible to transfer at least 4 weight percent of hydrogen to the MAF coal, for example in a system of the type illustrated, using naturally derived recycle solvent that is not hydrotreated. Recycled ash-to-coal input ratios of up to 1:1 may be added to provide additional ash catalysis in the hydroextraction. The recycle ash is added at conduit 59 from the conduit 47 or other suitable source and may be treated if desired to provide more uniform composition or particle size.

It is generally preferable to provide an amount of hydrogen transfer in the hydroextractor unit (10) or (10 and 10*a*) such that the pyrolyzer extract feed to conduit 21 has a Conradson carbon number not in excess of 40 weight percent (for example, 30 to 40 percent). The carbon residue in the extract would be determined by the usual Conradson destructive distillation method (see ASTM D189).

The process of this invention has substantial flexibility built into the system so that varying yields of gas, liquids and low or intermediate BTU fuel gas may be obtained. The operating conditions and hydrogen transfer rates can be adjusted to provide the most economical product mix.

The schematic drawings omit various conventional processing equipment which may be added to refine or upgrade the oil recovered from hydroextraction, flash distillation and extract pyrolysis. Such oil may be processed to hydrogenate gum-forming components or to eliminate the unsaturates or may be hydrocracked to obtain products of any desired molecular weight range.

The coal liquefaction system illustrated and described herein (excluding the unit 50) is essentially of the non-catalytic type because it can function without direct contact of conventional catalysts with the coal particles or the coal extract, and such system is identified herein as being "non-catalytic" when recycled ash is used. While the catalytic effect of ash particles is limited and less than that of conventional hydrogenation catalysts, the continual recycling of the ash particles at conduit 59 does catalyze the reactions and significantly enhances the fuel yields when the ash constitutes the sole catalyst.

It will be understood that the particle size of the coal or other solid carbonaceous material used in the practice of this invention may vary considerably and that the amount of recycle solvent may also vary. It will be understood that standard Tyler sieve sizes are given herein to indicate the size of the coal particles.

It will also be understood that parts and percentages are given by weight unless the context shows otherwise.

In accordance with the provisions of the patent laws, variations and modifications of the specific processes and devices disclosed herein may be made without departing from the spirit of the invention.

Having described my invention, I claim:

1. A multistage process for conversion of solid carbonaceous feed material to valuable liquid and gaseous products comprising passing a slurry of the particulate feed in a hydrocarbon oil solvent with hydrogen at high temperature and pressure through a reaction zone of a hydroextraction unit maintained under hydrocracking conditions to provide for coal dissolution, withdrawing liquid and gaseous effluent streams from the reaction zone including unconverted feed material, a fraction comprising a solvent oil being separated from the liquid effluent and continually recycled for mixing with the incoming particulate feed, the amount by weight of recycled solvent oil being greater than the amount of particulate feed and sufficient to dissolve most of the particulate feed, feeding that portion of the effluent stream from said hydroextraction unit containing the heavier oils and unconverted feed material to the reaction zone of a pyrolysis unit containing a fluidized bed of char and agglomerated ash particles to effect thermal cracking, withdrawing oil and gas from the residue of char and ash produced in said pyrolysis unit, feeding the char and agglomerated ash from said pyrolysis unit to the reaction zone of an ash-agglomerating char gasification unit and reacting it with an oxygen-containing gas and steam exothermically to produce fuel gas while generating heat and causing agglomeration of ash particles, and recycling the hot agglomerated ash from said gasification unit to the reaction zone of said pyrolysis unit to transfer heat to said reaction zone and to catalyze the cracking reactions therein.

2. The process of claim 1 in which said char gasification unit comprises a fluidized bed of char and ash particles and in which the ash particles in the bottom portion of the bed are heated and caused to agglomerate.

3. The process of claim 1 in which the hydrogenation and hydrocracking reactions in said hydroextraction unit are catalyzed primarily by addition to the slurry of ash particles corresponding to those which have passed through said gasification unit.

4. A coal liquefaction process of the non-catalytic type comprising dissolving dry comminuted coal in a solvent oil to form a slurry, mixing the slurry with hydrogen and subjecting it to hydrogenation and hydrocracking in a high-pressure hydroextractor maintained under conditions suitable for non-catalytic coal dissolution, separating the gas and oil from the residual coal extract, subjecting the extract to flash distillation to recover solvent oil for recycling, at least 90 percent by weight of the moisture-free coal being dissolved, feeding the coal extract to a pyrolysis unit in which it is heated under substantially non-oxidizing conditions to cause thermal cracking and to form a residue of char and ash, said pyrolysis unit containing a fluidizied bed of char and agglomerated ash particles, feeding the char and ash from said pyrolysis unit to a fluidized-bed ash-agglomerating char gasification unit which is maintained at a temperature higher than that of said pyrolysis unit by exothermic reaction of the char with oxygen and steam, whereby fuel gas is produced, causing agglomeration of ash particles in said gasification unit, and recycling hot ash agglomerates from said gasification unit to said pyrolysis unit to transfer heat to the latter and to catalyze the cracking reactions therein.

5. The process of claim 4 in which said char gasification unit contains a fluidized bed of ash and char particles and the fine ash particles are heated and caused to agglomerate at the lower part of the bed.

6. The process of claim 5 in which the bed of said char gasification unit is maintained at a temperature below the ash eutectic fusion temperature and above 1800° F.

7. The process of claim 4 in which the hydrocracking reactions in said hydroextractor are catalyzed primarily by continual addition to the slurry of ash particles which have passed through said gasification unit.

8. The process of claim 4 in which the hydrogen transfer in said hydroextractor is at least about 4 percent by weight of the moisture- and ash-free coal.

9. A continuous process for converting coal, peat or other carbonaceous material into liquid fuel comprising crushing, drying and classifying the material to provide dry comminuted particles of a predetermined moisture content, mixing the dry particles with a major amount by weight of a naturally-derived solvent oil to form a slurry containing at least 30 percent by weight of said carbonaceous material, preheating the slurry and adding hydrogen thereto to provide a three-phase gas-liquid-solid mixture, pumping said mixture into a hydroextraction unit at a pressure of at least 80 atmospheres and causing it to pass upwardly through the reaction zone of said unit, whereby the more reactive compounds are dissolved and the mixture leaving the unit comprises a first portion containing volatile light oil, gas and water and a second slurry portion containing the heavier extract and the unconverted solids, separating out said first portion and delivering it to a gas-oil recovery system wherein oil and high-energy fuel gas are recovered, delivering said second slurry portion to a flash distillation unit while releasing the high pressure to separate the lower boiling point oil from the remaining heavier extract containing the unconverted solids, delivering said lighter oil to said gas-oil recovery system, fractionating large amounts of oil from said recovery system to produce said naturally-derived solvent oil and recycling the latter for mixing with the aforesaid dry comminuted particles, said solvent oil causing at least 90 percent by weight of the dry particles to be dissolved before they are discharged from said hydroextraction unit, passing said heavier extract from said flash distillation unit to a fluidized bed pyrolysis unit maintained at a temperature of at least 900° F. and having a fluidized bed of hot ash and char, subjecting said heavier extract to thermal cracking in said pyrolysis unit under substantially non-oxidizing conditions while removing oil and gas from the top of the unit, continually removing ash and char from the bed of said pyrolysis unit and delivering it to a fluidized bed ash-agglomerating char gasification unit having a fluid bed of ash and char, causing air and steam to pass upwardly through the latter bed to fluidize the same and to react exothermically with the char to heat the bed to a temperature in excess of 1800° F. to convert the char to fuel gas which is removed from the upper portion of the gasification unit, continuously causing fine ash particles from said bed to come together and agglomerate, continually removing a portion of the agglomerated ash from the gasification unit, and continually recycling hot agglomerated ash from the latter unit to said pyrolysis unit to heat the same and to catalyze the reactions therein.

10. The process of claim 9 in which ash from said gasification unit is continually recycled to the slurry being fed to said hydroextraction unit to catalyze the hydrocracking reactions, said ash being the sole catalyst in said hydroextraction unit and being caused to flow with the slurry back to said pyrolysis unit.

11. The process of claim 9 in which the amount of hydrogen supplied to said solvent oil and to the slurry being fed to said hydroextraction unit is sufficient to provide a high yield of oil from the latter unit and such that the Conradson carbon content of the heavy extract entering said pyrolysis unit is not in excess of 40 percent by weight.

12. The process of claim 1 in which a hot zone is provided at the bottom of the fluidized bed of said gasification unit having a temperature substantially higher than the average temperature of the bed and such that the ash particles are softened and caused to agglomerate in said zone, and in which fine solid particles in the overheads from said pyrolysis unit and said gasification unit are separated out and caused to flow under pressure into the lower portion of said last-named bed toward said hot zone.

13. A multistage process for conversion of solid carbonaceous feed material to valuable liquid and gaseous products comprising passing a slurry of the particulate feed in a hydrocarbon oil solvent with hydrogen at high temperature and pressure through a reaction zone of a hydroextraction unit to effect coal dissolution, withdrawing liquid and gaseous effluent streams from the reaction zone including unconverted feed material, feeding a portion of the effluent stream from said hydroextraction unit containing the heavier oils and unconverted feed material to the reaction zone of a pyrolysis unit in which it is heated under substantially non-oxidizing conditions to effect thermal cracking, said pyrolysis unit comprising a fluidized bed of agglomerated ash and char particles maintained at a temperature of from about 900° to about 1200° F., continually removing ash and char from the bed of said pyrolysis unit and delivering it to a char gasification unit having a fluidized bed of ash agglomerates, fine ash and char, causing steam and an oxygen-bearing gas to pass upwardly through the latter bed to generate heat while producing fuel gas, causing a portion of the material in said last-named bed to pass to a high temperature accretion zone at said gasification unit wherein the outer surface portions of the ash particles are heated to a temperature at which such surface portions are softened and capable of adhering or fusing to other ash particles, bringing the ash particles into contact at said accretion zone to form ash agglomerates, cooling the agglomerated ash and recirculating the smaller particles thereof, and continually recycling the agglomerated ash particles from said char gasification unit to said pyrolysis unit to transfer sufficient heat to the latter unit to maintain a temperature of at least 900° F. therein and to catalyze the cracking reactions therein.

14. The process of claim 13 in which entrained fine solid particles in the overheads from said pyrolysis unit and said gasifier unit are separated out and recirculated through said last-named units, whereby such fine particles are eventually caused to agglomerate.

15. The process of claim 14 in which the gasification unit is maintained at a temperature of at least 1900° F. and particles at the bottom of the bed are caused to move downwardly and to converge at said accretion zone which is maintained at a temperature higher than the average temperature of said bed by supplying an oxygen-containing gas to said zone, and in which fine solid particles from said overheads are collected and fed toward said accretion zone.

16. The process of claim 14 in which lighter agglomerated ash particles from said accretion zone are raised by the flow of gases through the bed and caused to move toward the top of the bed and such particles are recycled to the bed of said pyrolysis unit, the recycled particles providing the heat required for said pyrolysis unit.

17. A process for treating a heavy residuum obtained by solvent hydrogenation of a slurry of coal particles comprising feeding said residuum to the reaction zone of a pyrolysis unit maintained under substantially non-oxidizing conditions to effect thermal cracking and recovery of oil and gas from said unit, said unit containing a fluidized bed of char and agglomerated ash particles, continually removing ash and char from the bed of said pyrolysis unit and delivering it to a char gasification unit having a fluidized bed of ash and char particles, causing steam and an oxygen-bearing gas to pass upwardly through the latter bed to fluidize the same and to react exothermically with the char to heat the bed to a temperature of from 1800° to 2400° F. to convert the char to fuel gas, causing accretion of the fine ash particles of the bed and formation of larger ash agglomerates in a high temperature accretion zone at said gasification unit having a temperature higher than the average temperature of said bed, recirculating a portion of the agglomerated ash particles through said gasification unit, and continually recycling hot agglomerated ash from said gasification unit to said pyrolysis unit to heat the latter unit and to catalyze the reactions therein.

18. The process of claim 17 in which heavier agglomerated ash particles from said accretion zone are cooled and removed and lighter agglomerated ash particles are caused to move upwardly through the bed of said gasification unit.

19. The process of claim 18 in which agglomerated ash particles near the top of the bed of said gasification unit are recycled to the bed of said pyrolysis unit.

20. The process of claim 19 in which fine ash particles entrained with gases leaving the top of said gasification unit are collected and returned to said hot accretion zone, whereby they adhere to larger agglomerated ash particles.

21. The process of claim 17 in which an elutriation zone is provided at the bottom of said gasification unit, the agglomerated ash particles from said accretion zone are cooled by gaseous fluid in said elutriation zone to cause separation of the particles, and larger heavier ash particles are removed while lighter agglomerated ash particles are returned to the bottom portions of the bed and caused to move upwardly through the bed.

22. The process of claim 21 in which the residuum comprises a coal extract with a Conradson carbon content of from about 30 to about 40 percent and a boiling range above 1040° F., said pyrolysis unit is maintained at a temperature of from about 900° to about 1200° F. by the hot recycled ash from said gasification unit, and the gasification unit is operated under conditions such that the larger agglomerated ash particles removed from said accretion zone and from said gasification unit have a carbon content no greater than 10 percent.

23. The process of claim 17 in which said char gasification unit is operated at a temperature of from about 1900° to about 2200° F.

24. The process of claim 17 in which said char gasification unit has an elutriation leg of reduced diameter near the bottom of the bed and the downwardly moving particles at the bottom of the bed are caused to converge in a high temperature accretion zone in said elutriation portion which is maintained at a temperature above the average temperature of said bed and sufficient to cause the ash particles to agglomerate, an oxygen-containing gas is supplied to said accretion zone, and steam is supplied to said elutriation leg below said accretion zone to cool the agglomerated particles while causing lighter agglomerated particles to move upwardly through the bed, heavier agglomerated particles being allowed to fall by gravity and being removed from said gasification unit.

25. The process of claim 17 in which said char gasification unit has an elutriation leg of reduced diameter near the bottom of the fluidized bed for receiving ash particles from the bed and means above said elutriation leg for directing steam and an oxygen-containing gas upwardly through the bed to fluidize the bed, and wherein steam is directed upwardly through the lower portion of the elutriation leg to force the lighter agglomerated ash particles upwardly into said bed, and an oxygen-containing gas is fed to the upper portion of said elutriation leg to increase the temperature at the top of said leg and to cause softening and accretion of the ash particles, whereby the larger heavier agglomerated ash particles fall to the bottom of said leg and the smaller lighter ash particles are returned to the bed.

26. A process for treating a residuum obtained by hydrogenation of a slurry of coal particles comprising feeding said residuum to the reaction zone of a pyrolysis unit maintained under substantially non-oxidizing conditions to effect thermal cracking and recovery of oil and gas from said unit, said unit containing a fluidized bed of char and agglomerated ash particles, continually removing ash and char from the bed of said pyrolysis unit and delivering it to a char gasification unit having a fluidized bed of ash and char particles and an elutriation leg of reduced diameter below the bed, causing steam and an oxygen-bearing gas to pass upwardly through the bed above said leg to fluidize the same and to react exothermically with the char to convert the char to fuel gas and ash, feeding air to a high-temperature accretion zone in the upper portion of said leg to cause softening and accretion of the ash particles, causing ash particles in the bed to move downwardly and converge at said accretion zone, whereby the ash particles agglomerate, and feeding steam upwardly through the lower portion of the elutriation leg to cool the ash agglomerates and cause the lighter agglomerates to move upwardly into said bed while permitting the larger heavier agglomerates to fall, cooling and removing the heavier agglomerates, and continually recycling the lighter agglomerates from the bed to said pyrolysis unit to provide the heat required for the latter unit, the entrained fine solid particles in the overheads from said gasification unit being separated out and returned to said high-temperature accretion zone.

* * * * *